United States Patent [19]

Yaman et al.

[11] 4,236,944

[45] Dec. 2, 1980

[54] CAST IRON ESPECIALLY SUITED FOR INGOT MOLDS

[75] Inventors: Melih Yaman; Kjell Gustavsson; Örjan Hammer, all of Sandviken, Sweden

[73] Assignee: Sandvik Aktiebolag, Sandviken, Sweden

[21] Appl. No.: 952,400

[22] Filed: Oct. 18, 1978

[30] Foreign Application Priority Data

Oct. 24, 1977 [SE] Sweden ..... 7711918

[51] Int. Cl.[3] ..... C22C 37/04

[52] U.S. Cl. ..... 148/35; 75/123 CB

[58] Field of Search ..... 75/123 CB; 148/35, 139, 148/140, 141

[56] References Cited

U.S. PATENT DOCUMENTS

| | | | |
|---|---|---|---|
| 2,516,524 | 7/1950 | Millis | 75/123 CB |
| 2,542,655 | 2/1951 | Gagnebin et al. | 75/123 CB |
| 3,109,733 | 11/1963 | Tisdale et al. | 75/123 CB |
| 3,726,670 | 4/1973 | Kusaka | 75/123 CB |
| 4,096,002 | 6/1978 | Ikawa et al. | 148/138 |
| 4,099,994 | 7/1978 | Ikawa et al. | 148/35 |

FOREIGN PATENT DOCUMENTS

| | | | |
|---|---|---|---|
| 1218035 | 1/1971 | United Kingdom | 148/35 |
| 1449052 | 9/1976 | United Kingdom | 148/35 |
| 377394 | 6/1973 | U.S.S.R. | 75/123 CB |

*Primary Examiner*—L. Dewayne Rutledge
*Assistant Examiner*—Peter K. Skiff
*Attorney, Agent, or Firm*—Burns, Doane, Swecker & Mathis

[57] ABSTRACT

This is provided an ingot mold formed of a cast iron consisting essentially of 3.7 to 4.0% C, not more than 1.6% Si, 0.40 to 0.80% Mn, 0.10 to 0.45% P, not more than 0.10% S, 0.020 to 0.050% Mg, the balance Fe with normally appearing impurities. The elements are adjusted to provide a specific carbon equivalent in the range of 3.2 to 3.6% calculated as $C_{eqv}$=%C+0.65% Si+0.35% P−35% Mg. In addition, the ingot mold structure of the present invention contains an amount of not more than 5% by volume of carbide, an amount of not more than 25% by volume of ferrite and at least two-thirds of the total graphite volume being spheroidal graphite with the balance pearlite.

3 Claims, 7 Drawing Figures

Decarburization depth (mm)
• Flake-graphite mould no. 184.
○ Vermicular-graphite mould no. 163, 183.
▲ Nodular-graphite mould no. 905, 906, 907.

Flake graphite
Vermicular graphite
Nodular graphite
16
14
12
10
8
6
4
2
10
20
30
40
50
60
70
80
Number of charges Depht of cracks (mm)

Flake graphite
Vermicular graphite
Nodular graphite
16
14
12
10
8
6
4
2
10
20
30
40
50
60
70
80
Number of charges

CAST IRON ESPECIALLY SUITED FOR INGOT MOLDS

The present invention relates to a cast iron especially suited for ingot molds, which possesses good resistance to deterioration in connection with thermal cycling thus prolonging the achievable time of use.

It is always a problem when casting ingots into molds to prevent crack initiation in the mold material in one way or another. The crack initiation is primarily a result of the deterioration of ductility that is a result of the fact that the structure is negatively affected during the thermal cycling with repeated exposure of the interior surface of the mold under oxidation ambient in connection with stripping the ingot from the mold. Various methods have been proposed for the purpose of improving the lifetime of such ingot molds one of which residing in changing the analysis of the ingot mold material, another residing in changing the design of the ingot mold. These proposals, however, have not yet been successful for various reasons.

British Pat. No. 1,218,035, for example, discloses a cast iron for ingot molds where the iron by inoculation has been affected to appear with a structure wherein vermicular graphite is distributed in a mainly pearlitic matrix at the same time as phosphorus and sulfur are present in certain low amounts. This which differs from commonly used cast iron, also did not result in increased resistance against thermal fatigue.

With the foregoing in mind it is an object of the invention to provide a cast iron that is more suited for ingot molds than those cast iron materials proposed to date. The lifetime of an ingot mold primarily depends on the properties of the material, from which the mold is produced. The following properties are desirable with an ingot mold material:

1. High strength and toughness at elevated temperatures and good thermal conductivity, which means good resistance to thermal shocks, thermal cycling and oxidation.

2. Insignificant shrinkage during solidification and good workability.

Extensive studies of the relations between the above properties and the analysis and structure of the cast iron have been conducted, which surprisingly have shown that it ought to be possible to have the consituents balanced against a certain carbon equivalent in a suitable manner for the purpose of reaching an optimum of the material properties related above.

According to the present invention there is provided a cast iron containing 3.7 to 4.0% C, not more than 1.6% Si, 0.4 to 0.80% Mn, 0.010 to 0.045 P, not more than 0.010% S, 0.020–0.050% Mg and the balance Fe with normally appearing impurities, the said elements being balanced against a specific carbon equivalent in the range 3.2 to 3.6% calculated as $C_{ekv.} = \%C + 0.65\%Si + 0.35\%P - 35\%Mg$.

According to a preferred embodiment of the invention there is provided a cast iron containing 3.7 to 4.0% C, not more than 1.3% Si, 0.40 to 0.70 Mn, 0.010 to 0.040% P, not more than 0.010% S, 0.020 to 0.040% Mg and the balance Fe with normal impurities, the said elements being balanced against a specific carbon equivalent in the range 3.3 to 3.6%.

According to another preferred embodiment of the invention there is provided a cast iron containing 3.7 to 3.9% C, not more than 1.1% Si, 0.45 to 0.60% Mn, 0.015 to 0.050% P, not more than 0.010% S, 0.020 to 0.040% Mg and the balance Fe and normal impurities, the said elements being balanced against a specific carbon equivalent in the range 3.3 to 3.6%.

The cast iron shall in all these cases be produced such that its structure contains carbide less than 5% of volume, ferrite not more than 25% of volume, graphite being spheroidal to a dominant amount, preferable at least ⅔ of total volume of graphite and the balance being pearlite.

The results of laboratory tests and full scale tests of the cast iron of the invention have shown that longitudinal and transverse cracks have almost entirely been eliminated as a reason for scrapping. As a consequence thereof this new material has shown to result in a lifetime that amounts to 1.25 to 1.75 times that of previously used ingot mold materials.

The cast iron of the present invention has a very good resistance to thermal fatigue. This has been achievable by optimizing its analysis as related above for the purpose of reaching a maximum of high-temperature strength and ductility.

In the Table I below is set out some compositions of castings of irons in accordance with the invention and some compositions beyond the scope of the invention, which have been subjected to hot tensile tests.

TABLE I

| | Chemical analysis of test materials | | | | | |
|---|---|---|---|---|---|---|
| Charge No. | C | Si | Mn | P | Mg | $C_{ekv.}$ |
| 6.28222 | 3.70 | 0.82 | 0.78 | 0.042 | 0.028 | 3.3 |
| 6.28170 | 3.91 | 0.83 | 0.77 | 0.042 | 0.031 | 3.4 |
| 6.53777 | 3.82 | 1.51 | 0.65 | 0.012 | 0.038 | 3.5 |
| 6.28214 | 3.64 | 1.68 | 0.78 | 0.044 | 0.031 | 3.7 |
| 6.28192 | 4.00 | 1.10 | 0.81 | 0.042 | 0.029 | 3.7 |
| 6.28162 | 3.88 | 0.97 | 0.01 | 0.065 | 0.019 | 3.9 |
| 6.28167 | 3.94 | 0.89 | 0.79 | 0.037 | 0.017 | 3.9 |
| 6.28251 | 3.92 | 0.89 | 0.78 | 0.025 | 0.016 | 3.9 |
| 6.28160 | 3.92 | 0.97 | 0.02 | 0.024 | 0.016 | 4.0 |
| 6.28168 | 3.97 | 0.95 | 0.79 | 0.072 | 0.018 | 4.0 |
| 6.28197 | 3.99 | 1.68 | 0.78 | 0.044 | 0.028 | 4.1 |

Melts for testing purposes were produced in an acid high-frequency induction furnace in which sufficient raw materials such as iron, ferrosilicon, Mn-metal and FeP had been added. The melt was then inoculated with FeSiMg for obtaining nodular graphite and the melt was poured at about 1330° C.

Test bars were then produced from the melt, which were subjected to hardness tests and tensile tests in a Gleeble-machine. In connection therewith said test bars were heated to a choosen test temperature (300°–1100° C.), was maintained 100 seconds at that temperature and then tensile tested at a constant speed of 25 mm/sec., whereby obtained values for area reduction ($\psi$) and ultimate strength ($\sigma_B$) were registered.

BRIEF DESCRIPTION OF THE DRAWINGS

It is essential that the constituents of the cast iron are present in amounts such as to give a carbon equivalent within the ranges stated. Presence of carbon highly contributes to prevent shrinkage during solidification and simultaneously give the cast iron good castability. In view thereof carbon should be present in an amount of at least 3.7 weight percent. The maximum carbon content should be 4.0% and preferably less than 3.9%, since hot-ductility and strength otherwise might decrease too markedly. In FIG. 1 is illustrated values that have been registered after a comparison between three different alloys with varying carbon content. As can be gathered therefrom a decreased ductility is the result of an analysis, when carbon content has not been adequately optimized against the other constituents.

Silicon might be present in a maximum amount of 1.6% but preferably should be present in an amount less than 1.3% and most preferably in an amount less than 1.1%. Higher silicon contents should be avoided since silicon, like carbon, will cause a decrease of hot-ductility and strength if not being adequately optimized. Cast irons containing low silicon amounts have a more clearly tendency of pearlite formation, which means improved ductility at temperatures above 700° C. A most rapid pearlite transformation is desirable since the two-phase structure austenite-ferrite causes a deterioration of the ductility. FIGS. 2 and 3 show the influence of C, Si and C+S on strength properties. As can be gathered therefrom too high silicon amounts, if not adequately optimized, have markedly decreased the strength properties.

Presence of manganese improves ductility and strength and should, therefore, appear in the cast iron in amounts of at least 0.40% and not more than 0.80%. Since manganese stabilizers pearlite formation and decreases the carbon activity manganese will advantageously reduce graphite growth at thermal cycling. Manganese content, however, should not exceed 0.70% and should preferable amount of 0.45% to 0.60% having regard to internal oxidation and cementite formation during solidification.

Figure 1:
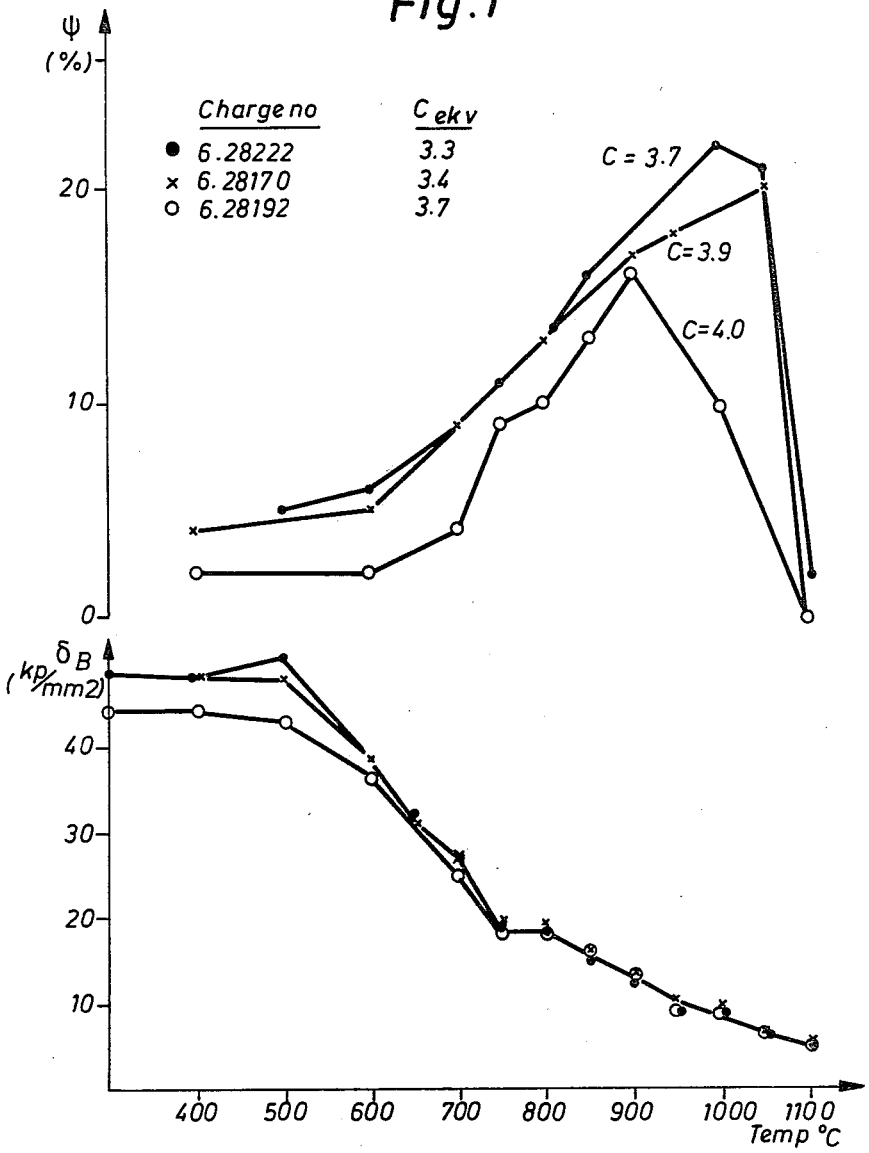
FIG. 1 is a graph of various physical properties versus temperature for three particular ingot mold compositions of varying carbon contents.
Figure 2:
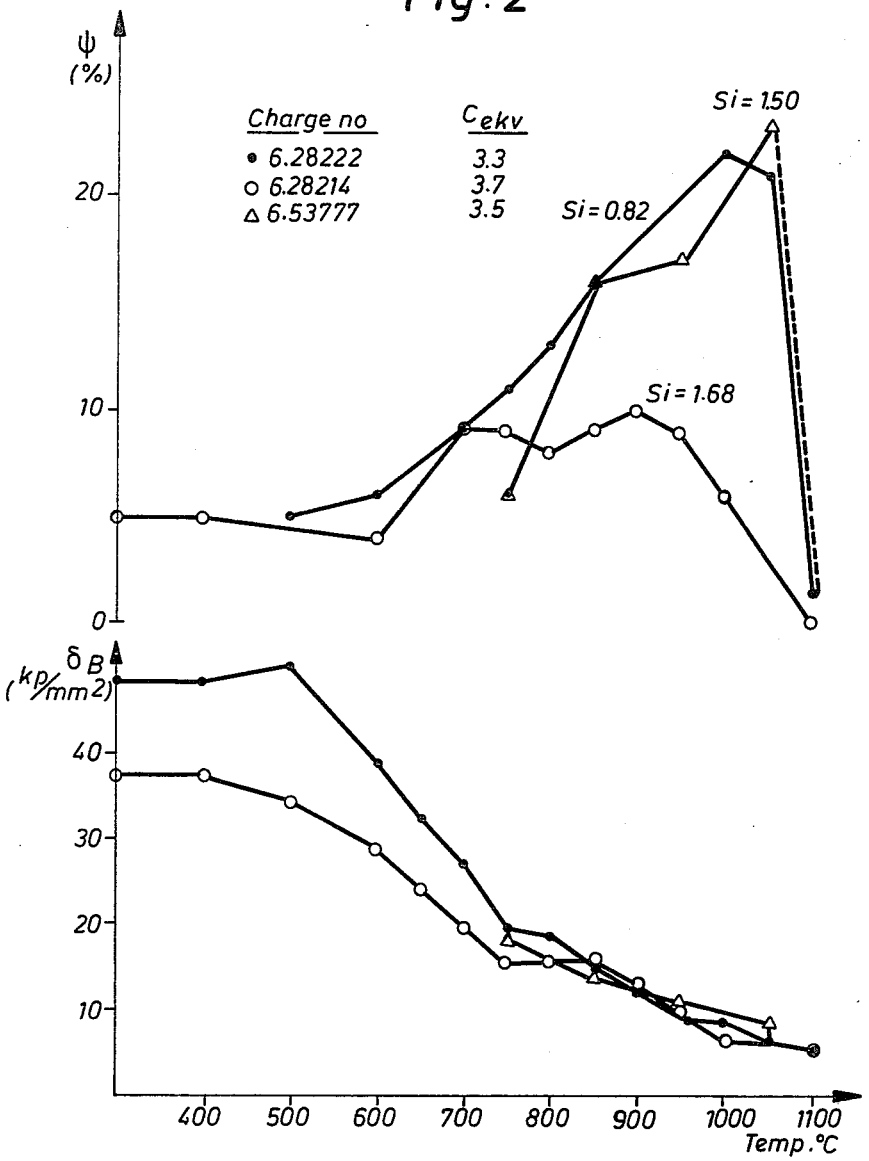
FIG. 2 is a graph of various physical properties versus temperature for three particular ingot mold compositions of different silicon contents.
Figure 3:
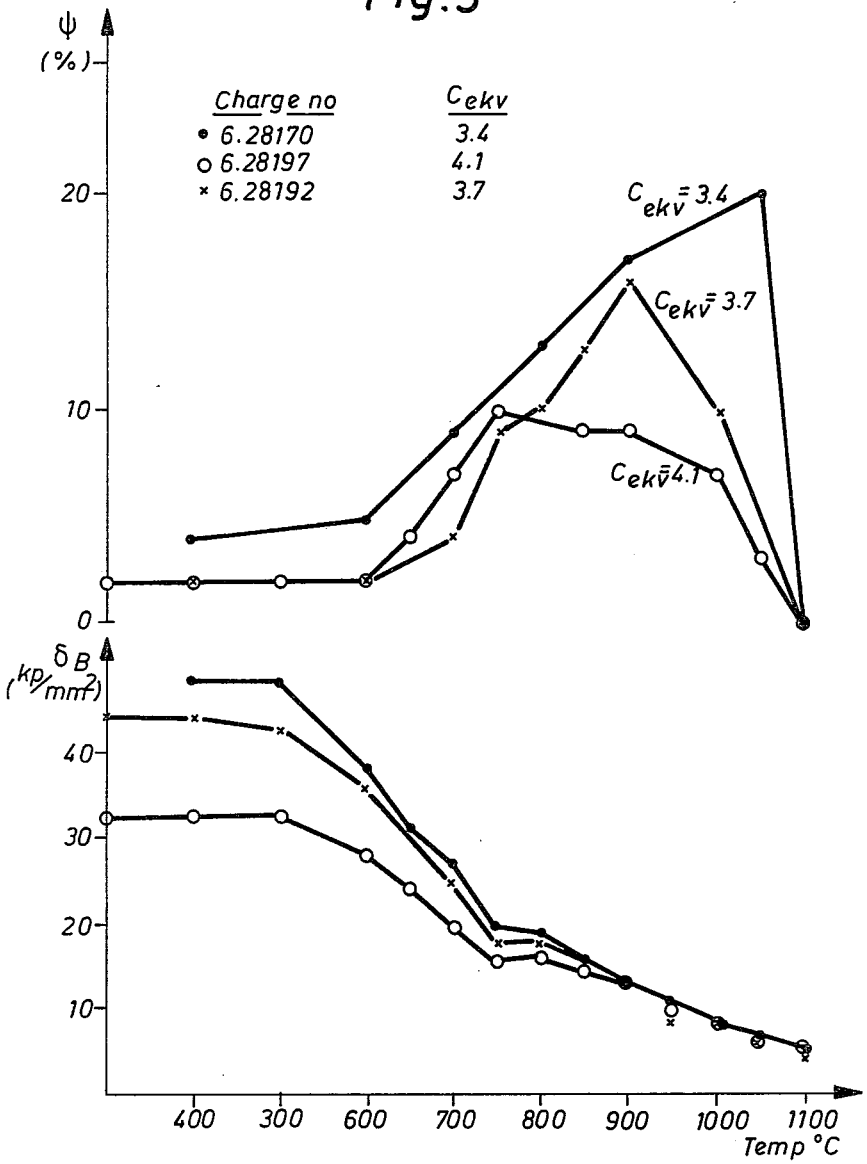
FIG. 3 is a graph of various physical properties versus temperature for three particular ingot mold compositions of differing silicon and carbon equivalent contents.
Figure 4:
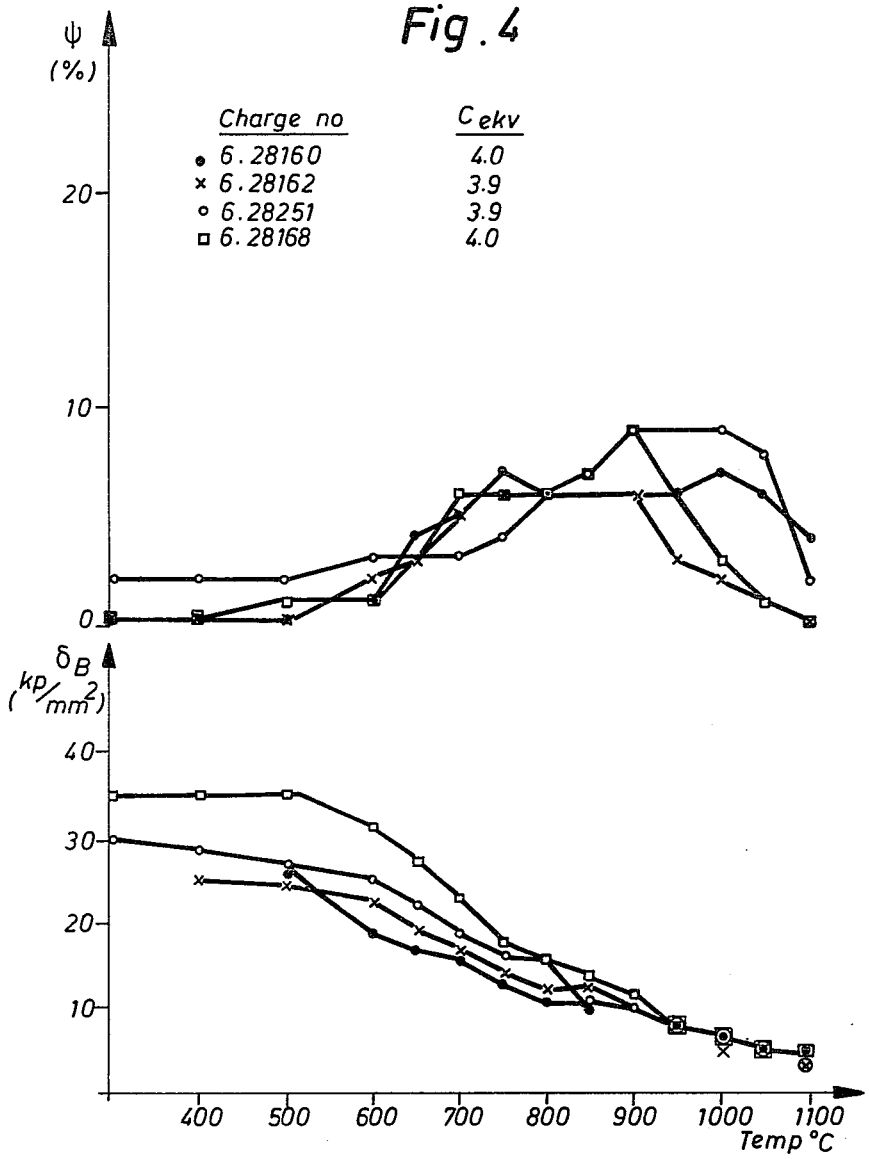
FIG. 4 is a graph of various physical properties versus temperature for four particular ingot mold compositions of different phosphorus content relative to other elements.

Phosphorus ought to be present in an amount of at least 0.010% and should preferably amount to at least 0.015% since presence of phosphorus increases the strength. The phosphorus content, however, should be optimized in relation to the elements C, Si and Mg. FIGS. 3 and 4 show that unbalanced phosphorus causes a decrease of the burning limit, i.e. the limit when ductility abruptly decreases. Phosphorus could be present in amounts up to 0.045 but ought to be less than 0.040% and, if silicon content is high, preferably should be lower than 0.030%.

The sulphur may be present in about same contents as normally used, which means contents up to a maximum of 0.010%.

Figure 5:
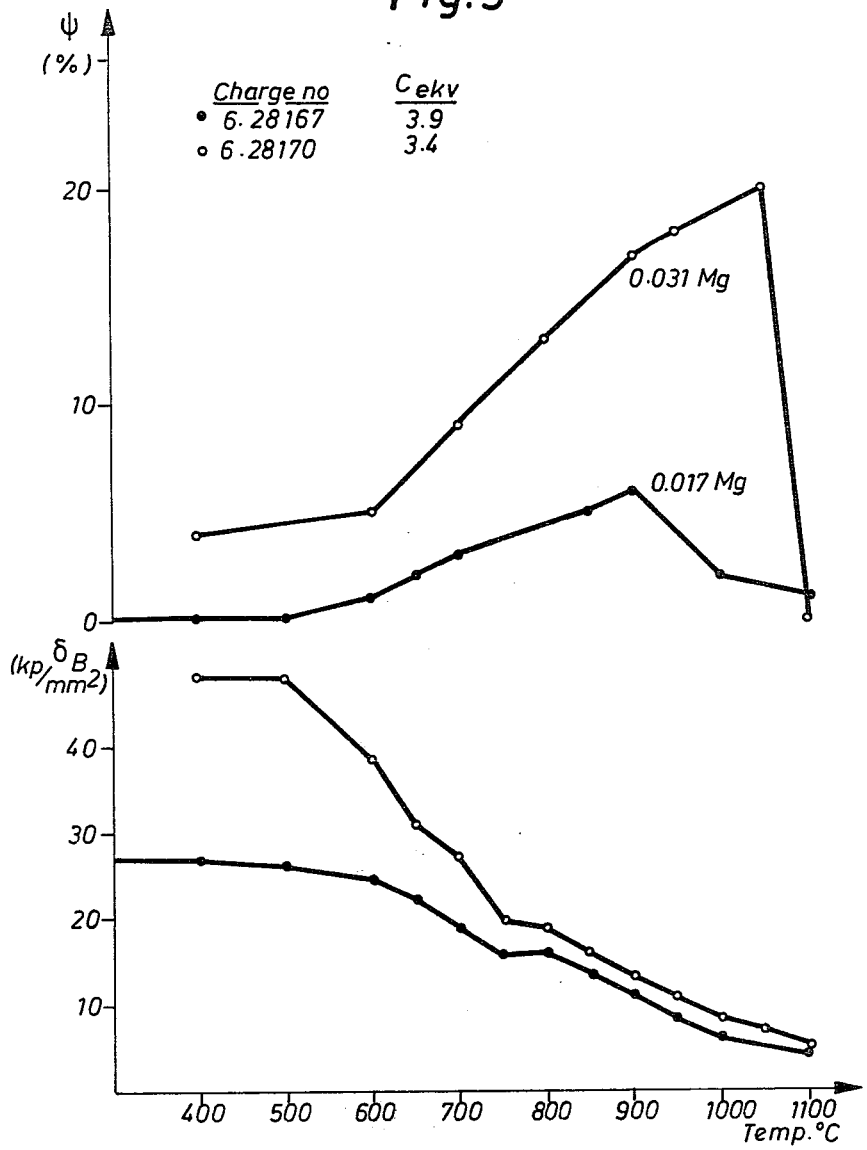
FIG. 5 is a graph of various physical properties versus temperature for two particular ingot mold compositions having different magnesium contents.

Magnesium affects the graphite formation. A successively increasing magnesium content causes changes of the graphite from lamellar to vermicular structure and finally to nodular structure. It is essential that a sufficiently high magnesium content is maintained so as to obtain fully nodular graphite. This graphite formation has been found to be necessary in cast iron for ingot molds with regard to crack initiation. Hence, magnesium content should be a value between 0.020 and 0.050%, preferably between 0.020 and 0.040%. Presence of magnesium also contributes to improve hot ductility properties and stabilize pearlite. FIG. 5 shows ductility values for two test samples, one of which contains magnesium at an amount that has not been adequately optimized. A clear decrease of the ductility is a visible result thereof.

Figure 6:
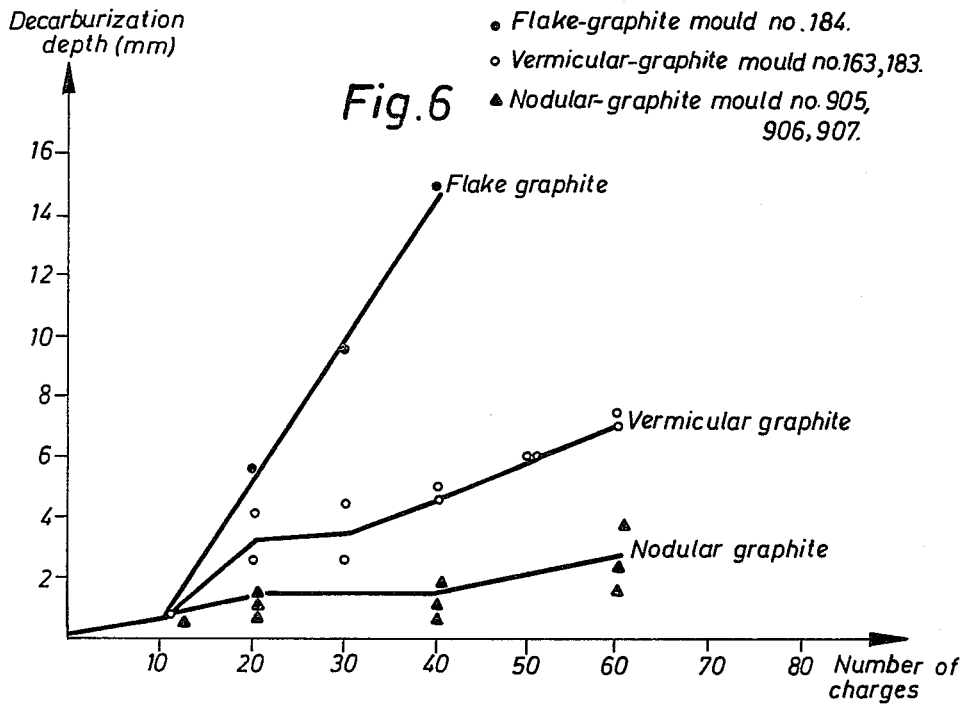
FIG. 6 is a graph of decarburization depth versus number of charges for different graphite forms.
Figure 7:
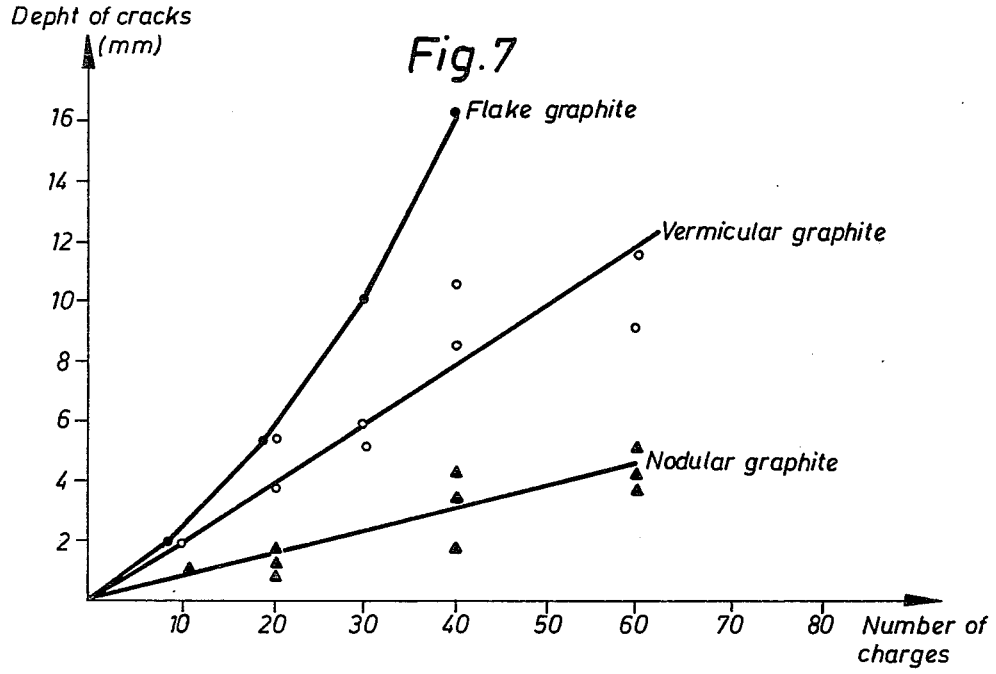
FIG. 7 is a graph of depth of cracks versus number of charges for different graphite forms.

It is essential that a matrix structure suitable for ingot mold production is present in the cast iron. Laboratory studies and full scale studies of the material here under consideration have shown that the present cast iron has improved structure stability. The present cast iron shall be produced such that its carbide amount not exceeds 5 percent of volume, ferrite not more than 25% of volume, graphite is nodularized to a dominant part, preferably to at least ⅔ of total graphite volume and the balance being pearlite. The speed at which the internal oxidation and the change of structure occurs is determined of the speed of decarburization and crack initiation. As can be gathered of the speed of decarburization and crack initiation. As can be gathered from FIGS. 6 and 7 the nodular graphite gives less decarburization depth and hence also decreased possibilities for crack initiation. In order that the present cast iron simultaneously shall obtain sufficiently high strength it is necessary to limit the ferrite content. This is achievable primarily by optimizing the manganese content in the manner previously related. From the aspect of physical properties it is simultaneously important to adequately optimize the content of phosphorus. Carbon and silicon both cause an increased phosphorus activity. When both these elements are present in higher amounts within the ranges stated it must consequently be controlled that the content of phosphorus is low enough so as to avoid decrease of hot-ductility at high temperatures.

The results of using ingot molds produced from prior art cast irons (nos. 163–186) and results of using ingot molds produced from a cast iron of the present invention (nos. 901–907) have indicated that a considerable improvement of the durability of the mold has been found achievable. In Table II below actual material analysis have been listed. As regards graphite formation as appearing in the structure it shall be noticed that designation numbers I, III and VI correspond to flaked graphite, vermicular graphite and nodular graphite respectively. Hence, mould sample no. 163 is indicated to comprise a graphite structure type III—VI distribution 14-1, which means that graphite is present in nodular form to an amount of 1/15 whereas the balance of graphite has vermicular configuration.

The results of full scale testing have been indicated in Table III and in each specific case the reason for scrapping has been indicated by codes. Codes 3, 4, 6 and 7 are directly coupled to the ingot mould material per se whereas the other codes refer to scrapping, which primarily occurs from the handling of the ingot molds. As regards code no. 3, it has been indicated after how many charges vertically extending cracks have been observed. The results can be summarized as follows:

1. Longitudinally and transversely extending cracks have mainly been eliminated as a reason for scrapping the molds.

2. The durability of the mold has been improved at an order of 1.25–1.7 times, which has resulted in decreased consumption mould material/to steel.

As an example it can be mentioned that steel consumption decreased from 14.9 to 9.7 kilos ingot mold for each ton steel produced with an ingot mould indicated Sandvik 27", which is the mould design referred to in Table III.

TABLE II

| Mold type No. | Charges before scrapped | Analysis % C | % C-ek. | % Si | % Mn | % P | % S | % Mg | Graphite Type | Distr. % | Total % | Pearlite % | Ferrite % | Carbide % |
|---|---|---|---|---|---|---|---|---|---|---|---|---|---|---|
| Sandvik 27" | | | | | | | | | | | | | | |
| 163 | 60 | | | | | | | | III-VI | 14–1 | 15 | 18 | 65 | 2 |
| 165 | 41 | 3.92 | 4.0 | 1.02 | 0.33 | 0.031 | 0.002 | 0.018 | III | 15 | 15 | 18 | 65 | 2 |
| 166 | 48 | | | | | | | | III | 15 | 15 | 18 | 65 | 2 |
| 183 | 86 | 3.92 | 3.6 | 0.42 | 0.05 | 0.027 | 0.005 | 0.017 | III-VI | 13–2 | 15 | 15 | 67 | 3 |
| 184 | 42 | | | | | | | | | | | | | |
| 185 | 57 | 3.89 | 4.3 | 1.23 | 0.70 | 0.012 | 0.005 | — | I | — | 20 | 65 | 15 | — |
| 186 | 57 | | | | | | | | | | | | | |
| 901 | 83 | | | | | | | | III-VI | 2–13 | 15 | 64 | 20 | 1 |
| | | 3.82 | 3.5 | 1.03 | 0.55 | 0.028 | 0.006 | 0.027 | | | | | | |
| 902 | 94 | | | | | | | | III-VI | 2–13 | 15 | 63 | 20 | 2 |
| 903 | 96 | | | | | | | | III-VI | 4–11 | 15 | 56 | 25 | 4 |
| | | 4.01 | 3.5 | 0.86 | 0.44 | 0.029 | 0.007 | 0.030 | | | | | | |
| 904 | 90 | | | | | | | | III-VI | 5–10 | 15 | 57 | 25 | 3 |
| 905 | 111 | | | | | | | | III-VI | 2–13 | 15 | 65 | 15 | 5 |
| | | 3.79 | 3.4 | 1.10 | 0.57 | 0.029 | 0.007 | 0.032 | | | | | | |
| 906 | 117 | | | | | | | | III-VI | 2–13 | 15 | 64,5 | 20 | 0.5 |
| 907 | 113 | 3.90 | 3.4 | 0.96 | 0.50 | 0.030 | 0.005 | 0.035 | III-VI | 2–13 | 15 | 64,5 | 20 | 0.5 |

TABLE III

| Mold type No. | FIELD TESTING Number of Charges | Reasons for scrapping | TEST INGOT MOLDS xx Ageing indications 1 | 2 | 3 | 4 | 5 | 6 | 7 | 8 |
|---|---|---|---|---|---|---|---|---|---|---|
| SANDVIK 27" | | | | | | | | | | |
| 163 | 60 | 3 | | | 21ch | | | II | 2mm | |
| 165 | 41 | 3 | | | 15ch | | | I | 2mm | |
| 166 | 48 | 3 | | | 28ch | | | I | | |
| 183 | 86 | 3 | | | 21ch | | | III | 12/8mm | |
| 184 | 42 | 3 | | | 21ch | | | I | | |
| 185 | 57 | 3 | 57ch | | 26ch | | | I | | |
| 186 | 57 | 3 | | | 26ch | | | I | | |
| 901 | 83 | 1 + 2 | 57ch | 83ch | 0 | | | II-III | 4/5mm | 80ch |
| 902 | 94 | 2 + 5 | — | 94ch | 0 | 0 | 12mm | II-III | 6/6.5mm | 80ch |
| 903 | 96 | 2 + 5 | 80ch | 96ch | 80ch | 0 | 5mm | II-III | 4/5mm | 80ch |
| 904 | 90 | 2 + 5 | 90ch | 90ch | 0 | 0 | 12mm | III | 4/9mm | 80ch |
| 905 | 111 | 2 | 102ch | — | 0 | 0 | | II-III | 5/1mm | 80ch |
| 906 | 117 | 2 | — | — | 0 | 0 | | II-III | 5/1mm | 80ch |
| 907 | 113 | 2 | — | — | 0 | 0 | | II | 4/3mm | 60ch |

xxageing indications and/or scrapped

Code

[1]Erosion cavities from stream of steel

[2]Ingot stuck in the moulds - remmed out

[3]Vertical cracks

[4]Horisontal cracks

[5]"Stickers" owing to the bottom having bent up and steel having solidified under the mould

[6]Crazing of the inner surface: I = inconsiderable, II = smooth surface where the pattern of crazing is evident, III = crazing beginning to come out of the grain boundaries, IV = considerable crazing-cracks propagated from the surface

[7]Outside bending ( = thermal deformation) measured in mm from a straight ruler

[8]Burnt inner surface

We claim:

1. An ingot mold formed of a cast iron consisting essentially of 3.7 to 4.0% C, not more than 1.6% Si, 0.40 t 0.80% Mn, 0.010 to 0.045% P, not more than 0.010% S, 0.020 to 0.050% Mg, the balance Fe with normally appearing impurities, the said elements being adjusted to provide a specific carbon equivalent in the range 3.2 to 3.6% calculated as $C_{eqv}$=% C+0.65% Si+0.35% P−35% Mg, the ingot mold structure containing an amount of not more than 5% of volume of carbide, an amount not more than 25% of volume of ferrite, at least ⅔ of total graphite volume of spheroidal graphite and the balance pearlite.

2. The ingot mold of claim 1 wherein the cast iron consists essentially of not more than 1.3% Si, 0.40 to 0.70% Mn, 0.010 to 0.040% P and 0.020 to 0.040% Mg, the specific carbon equivalent being in the range of from 3.3 to 3.6%.

3. The ingot mold of claim 2 wherein the cast iron consists essentially of 3.7 to 3.9% C, not more than 1.1% Si and 0.45 to 0.60% Mn.

* * * * *

UNITED STATES PATENT AND TRADEMARK OFFICE

CERTIFICATE OF CORRECTION

PATENT NO. : 4,236,944

DATED : December 2, 1980

INVENTOR(S) : Melih Yaman, Kjell Gustavsson, Orjan Hammer and Per Gösta Nystedt.

It is certified that error appears in the above-identified patent and that said Letters Patent are hereby corrected as shown below:

On the cover page, in paragraph [75] Inventors:, line 2, after "Sandviken," insert --Per Gösta Nystedt, Storå,--.

Signed and Sealed this

*Fifth* Day of *May 1981*

[SEAL]

*Attest:*

RENE D. TEGTMEYER

*Attesting Officer*

*Acting Commissioner of Patents and Trademarks*